US009090434B2

(12) United States Patent
Wüest et al.

(10) Patent No.: US 9,090,434 B2
(45) Date of Patent: Jul. 28, 2015

(54) FLOOR FOR AN ELEVATOR CAGE

(75) Inventors: Thomas Wüest, Hochdorf (CH); René Strebel, Buttwil (CH); Urs Schaffhauser, Root (CH); Beat Brügger, Lucerne (CH); Christoph Schuler, Cham (CH); Lukas Zeder, Huddinge (SE)

(73) Assignee: Inventio AG, Hergiswil (CH)

( * ) Notice: Subject to any disclaimer, the term of this patent is extended or adjusted under 35 U.S.C. 154(b) by 497 days.

(21) Appl. No.: 13/435,408

(22) Filed: Mar. 30, 2012

(65) Prior Publication Data

US 2012/0255811 A1 Oct. 11, 2012

(30) Foreign Application Priority Data

Apr. 6, 2011 (EP) ..... 11161363

(51) Int. Cl.
*B66B 11/02* (2006.01)

(52) U.S. Cl.
CPC ..... *B66B 11/0226* (2013.01)

(58) Field of Classification Search
CPC ..... B66B 11/0226
USPC ..... 187/401, 343
See application file for complete search history.

(56) References Cited

U.S. PATENT DOCUMENTS

| | | | | |
|---|---|---|---|---|
| 2011/0147358 | A1 * | 6/2011 | Kober et al. | 219/202 |
| 2012/0160614 | A1 * | 6/2012 | Schuler et al. | 187/401 |

FOREIGN PATENT DOCUMENTS

| | | | | |
|---|---|---|---|---|
| EP | 0566424 | A1 | 10/1993 | |
| EP | 1004538 | A1 | 5/2000 | |
| JP | 02163280 | A * | 6/1990 | B66B 11/02 |
| JP | 03152080 | A * | 6/1991 | B66B 11/02 |
| JP | 8073157 | A | 3/1996 | |
| JP | 2005263427 | A | 9/2005 | |
| JP | 2010228880 | A * | 10/2010 | |
| WO | WO 2013026489 | A1 * | 2/2013 | |

OTHER PUBLICATIONS

English Translation of JP 2005-263427 A.*

* cited by examiner

*Primary Examiner* — Michael Mansen
*Assistant Examiner* — Diem Tran
(74) *Attorney, Agent, or Firm* — Fraser Clemens Martin & Miller LLC; William J. Clemens

(57) ABSTRACT

A floor for an elevator cage has a base plate, a top plate and a support structure arranged therebetween. The support structure comprises a grating arrangement including a plurality of intersecting profile members standing on edge. For local reinforcement, the support structure additionally includes a second grating arrangement superimposed on the first arrangement.

15 Claims, 4 Drawing Sheets

FLOOR FOR AN ELEVATOR CAGE

CROSS-REFERENCE TO RELATED APPLICATION

This application claims priority to European Patent Application No. 11161363.4, filed Apr. 6, 2011, which is incorporated herein by reference.

FIELD

The disclosure relates to a floor for an elevator cage.

BACKGROUND

Elevator cages are, for example, installed in cage frames which in turn are guided at rails fastened in elevator shafts and are moved up and down by drive engines via wire cables or other support means. Stiff cage floors can be executed in composite structure mode of construction or sandwich mode of construction, whereby the floor is distinguished by a high static and dynamic capability of loading and by a comparatively low weight. A 'sandwich' floor of that kind can be constructed substantially from, for example, the following components: a first plate (base plate) for predetermining a lower side, a second plate (top plate) spaced from the first plate and a support structure arranged therebetween.

SUMMARY

In at least some embodiments, a floor can, even under particularly high mechanical loads, satisfy high demands with respect to stiffness and capability of loading.

In particular embodiments of a floor, the flat lower side for the floor can be formed by a metallic plate, for example of steel. A second plate for predetermination of the flat upper side can be arranged approximately piano-parallel to this base plate. This top plate can, like the base plate, similarly consist of steel or another metallic material. However, other materials or compositions can be provided for the mentioned plates. The plates for predetermination of the lower side and upper side could, for example, be constructed from fiber-reinforced materials or from layers laminated together. In order to stiffen the floor a support structure having, in general, a first packing density is located between the upper side and the lower side. The first packing density is in that case predetermined by a first arrangement with walls or wall segments distributed approximately uniformly with respect to a plan view. The plan view in that case arises through viewing in the direction of the surface normals of a base surface of the base. In the installed state the plan view is accordingly defined by a vertical direction or by the travel direction of the cage. For local stiffening of the floor the support structure has in the reinforced region a second packing density which is higher by comparison with the first packing density. In order to form this local reinforcement the support structure has a second arrangement which is disposed in the first arrangement and overlaps the first arrangement in a region of overlap. Locally reinforced in that case means that the support structure is additionally reinforced not over the entire floor area, but only in a sub-region of the floor area. In other words, the support structure has the first packing density at least in a region outside—with respect to the plan view—the region of overlap. The support structure could comprise a honeycomb structure (for example, a bee honeycomb structure). Conventional honeycomb structures are distinguished by uniformly distributed and identically constructed honeycomb. In some embodiments, the local reinforcement of the honeycomb structure can be created by the structure comprising a zone (reinforced region) with smaller cells. The smaller cells could—in correspondence with the first arrangement predetermining the basic structure—have the form of a bee honeycomb. The cells can also have other shapes. The zones with smaller cells are distinguished, by comparison with the zone with the first packing density, by an apparent higher packing density. Due to the local reinforcement in accordance with some embodiments of the cage floor it is possible, for example, to optimally absorb high impact energies on the lower side of the floor.

The floor can comprise a support structure forming a layer or sandwich course. The first arrangement and the second arrangement would then be in the same layer or sandwich course. A floor with several support structure layers can also be possible.

The support structure can have walls or wall segments which extend from the lower side to the upper side or bridge over the spacing between lower side and upper side and which are associated with the first arrangement as well as the second arrangement. The walls or wall segments can consist of the same material as the base plate and top plate. However, other materials for the support structure can also be possible. Moreover, it would also be conceivable to dispense with a base plate for specific cases of use. In these variants the lower side of the floor would be predetermined by the support structure.

In further embodiments, the support structure comprises a first arrangement with walls or wall segments distributed approximately uniformly over the floor are and predetermining the first packing density. The support structure further comprises a second arrangement, which is superimposed on the first arrangement, for local reinforcement. The second arrangement can be a separate component (or subassembly) which is separate from the first arrangement and which is placed in or on the first arrangement and optionally connected therewith by, for example, welding. The floor construction can be produced particularly simply and in a few working steps.

The walls or wall segments of the second arrangement can, for example, be connected with the walls or wall segments of the first arrangement by shape-locking and/or force-locking couple. Thus, for fixing a support structure composed of first and second arrangements the second arrangement can be welded to the first arrangement.

The first arrangement with the first packing density can consist of a plurality of intersecting profile members which stand on edge and which form a kind of grating. A simple floor with a grating configuration of that kind is described in EP 1 004 538 A1. In addition to the first grating arrangement the support structure can comprise a second grating arrangement or even a plurality of second grating arrangements. In the last-mentioned case the individual second grating arrangements can be distributed uniformly or non-uniformly over the floor area. Through the superimposition of the first grating by a second grating there arises in the region of superimposition or overlap a structure with a second packing density which is higher by comparison with the first packing density of the base structure. Excellent values with respect to mechanical capability of loading and to stiffness can thereby be achieved in particularly simple mode and manner. In particular, through this local reinforcement undesired deformations of the floor after collision with a buffer arranged at the shaft floor or another object can be avoided in simple manner.

It can be advantageous if a respective profile member of the second arrangement is arranged between two adjacent profile members of the first arrangement. However, it is also conceivable for two or more profile members of the second arrangement to be disposed in each instance between two adjacent profile members of the first arrangement.

It can be advantageous if not only the profile members of the first arrangement, but also the profile members of the second arrangement are provided with slots, which are associated with crossing points, for reception of intersecting profile members. The intersecting profile members of the first arrangement and the intersecting profile members of the second arrangement have, respectively, mutually facing slots. In order to join together the first arrangement and the second arrangement the respective profile members can be provided with further slots. For this purpose, the already joined longitudinal and transverse profile members of the first arrangement can have slots, which are oriented in the same direction, for receiving the joined longitudinal and transverse profile members of the second arrangement, which in turn have corresponding slots oriented as a group in the same direction. The second grating (assembled second arrangement) can thus be connected in a single working step with the first grating (assembled second arrangement) particularly by placing on from one side. The two grating arrangements, i.e. the first and second arrangements, can, prior to being joined together, each be formed as a rigid subassembly. For example, the arrangements formed as rigid subassemblies can comprise profile members fixed in the crossing position by means of welding, gluing or another method.

For a floor having a specific width and length it can be advantageous if the profile members of the second arrangement extend in profile member length direction in each instance over at least half the width or length of the floor. This form of embodiment could be advantageous for second arrangements positioned approximately centrally in the floor. However, other dimensions for the profile member lengths of the second arrangement could also be advantageous.

In some embodiments, the profile members of the first arrangement and the profile members of the second arrangement have the same material thickness. In some cases, production outlay and costs can be further reduced in this way.

In some cases, the local reinforcement is arranged centrally in the floor with respect to a plan view.

The intersecting profile members of the first and second arrangements can form chambers which can be partly or entirely filled with a suitable filler material for weighting and balancing the cage. Various materials suitable for weighting the elevator cage can be used as filler material. Thus, cement, aggregate, stones, liquids, oils, metal bodies, including lead bodies, etc., are conceivable. In that case, the filler material can be embedded in an embedding mass such as, for example, a silicon, gel, rubber, cement, plastics material, etc. Thus, for example, undesired movements of the filler material can be prevented. The filler material can be filled into, or in a given case also removed or emptied from, at least one of the chambers of the support structure of the elevator cage during production of the elevator cage floor, during assembly of the elevator installation and/or within the scope of maintenance of the elevator installation.

Further embodiments include an elevator with an elevator cage with a floor described in the foregoing.

In some embodiments, if the elevator has in the shaft floor a buffer element for catching an elevator cage in an end position, it can be advantageous if the elevator cage is so constructed that the local reinforcement is arranged in a region which overlaps, with respect to a plan view, the buffer element and if the end position the buffer element is supported directly on the floor. By contrast to conventional elevators, in which the support takes place by way of a horizontally extending frame profile member associated with the cage at the floor side, the present design can have some advantages. Apart from the saving in weight, less bulky and thus more slender cage constructions can thereby also be achieved.

BRIEF DESCRIPTION OF THE DRAWINGS

The disclosed embodiments are discussed with the drawings, in which.

DETAILED DESCRIPTION

Figure 1:
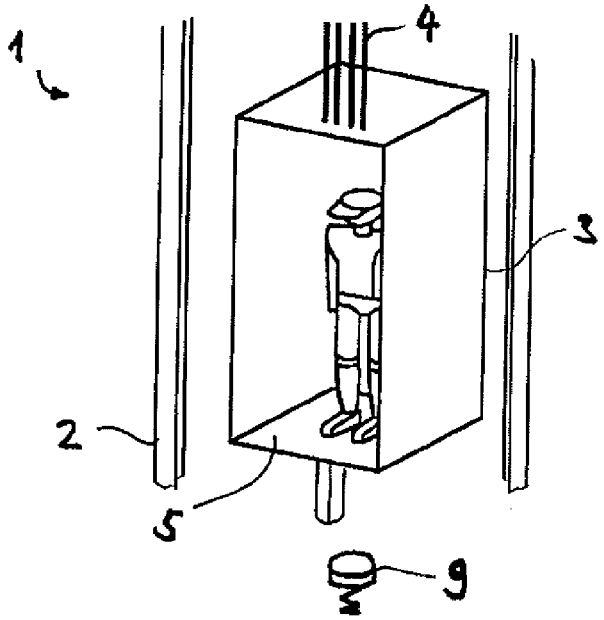
FIG. 1 shows a substantially simplified perspective illustration of an elevator with an elevator cage.

FIG. 1 shows an elevator, which is denoted generally by 1, with a cage 3 fastened to support means 4. The shaft is illustrated schematically and denoted by 2. Such or similar elevators have been known for a long time and are customary. In the embodiment according to FIG. 1 a resiliently mounted buffer element 9 for catching the cage 3 in an end position is located at the shaft floor. The buffer element 9 is disposed approximately centrally below a floor 5 of the cage 3. The floor 5 is constructed in such a manner that the buffer element 9 can be supported directly or without intermediary on the floor. In order to accept an impact on the buffer, the floor 5 is in addition reinforced centrally. This reinforcement is described in detail in the following with reference to FIGS. 2 to 6.

Figure 2:
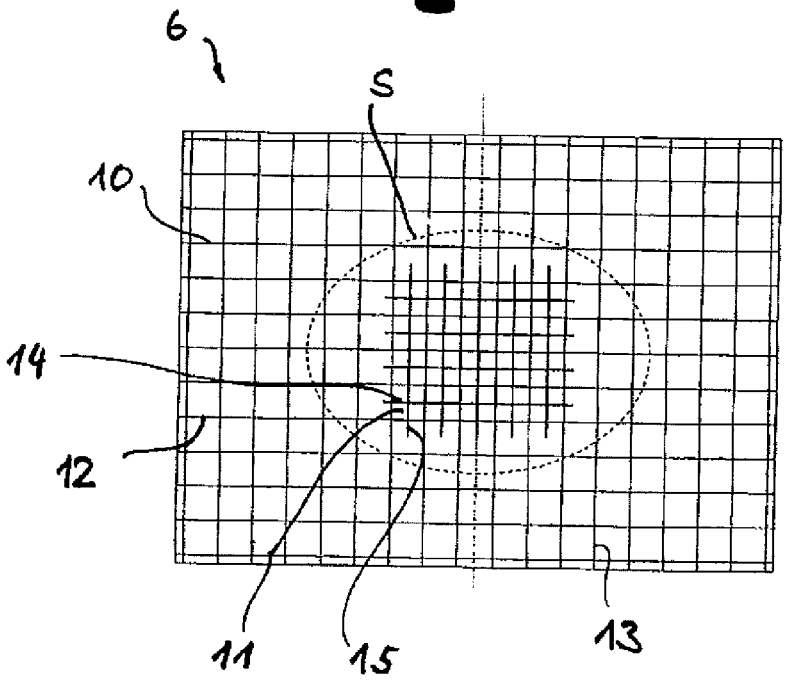
FIG. 2 shows a plan view of a support structure for a floor of an elevator cage.
Figure 3:
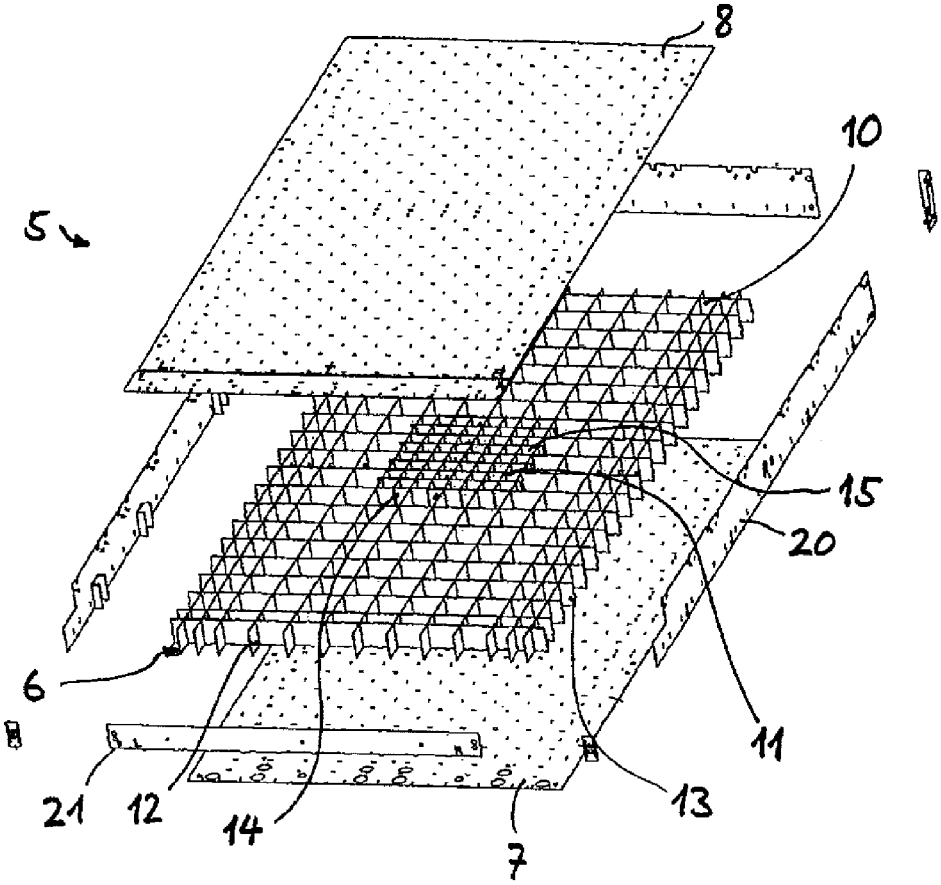
FIG. 3 shows an exploded perspective illustration of an exemplary embodiment of a floor for the elevator cage.
Figure 4:
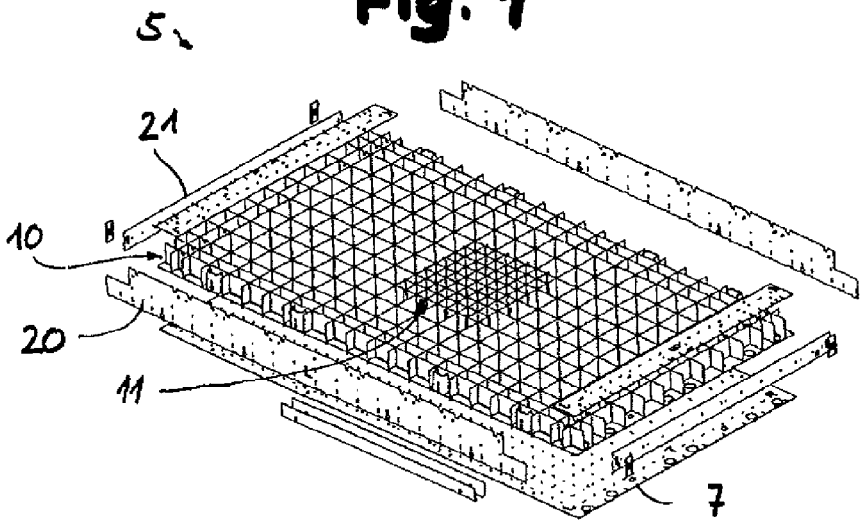
FIG. 4 shows the floor of FIG. 3 from a different viewing angle.
Figure 5:
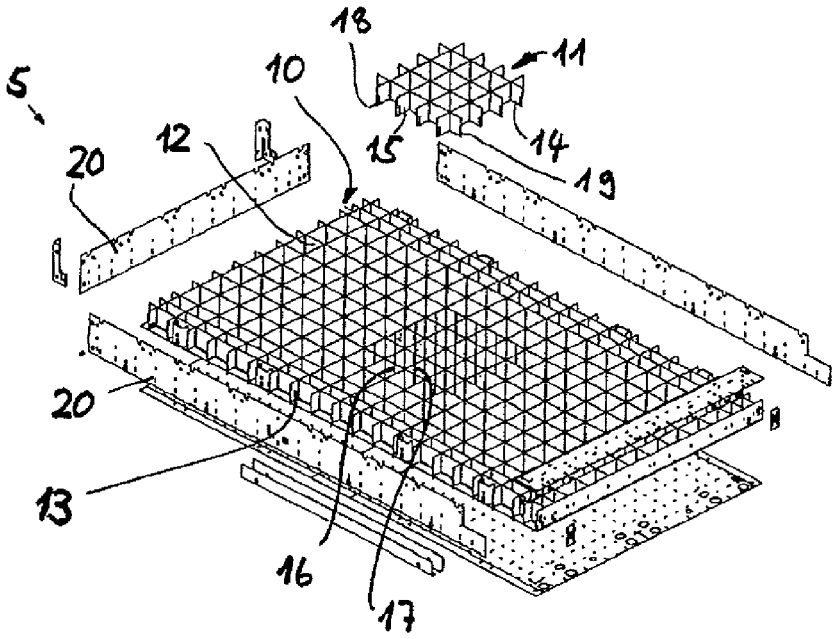
FIG. 5 shows the floor according to FIG. 4 with a support structure assembled to finished state.

A possible variant, which is denoted by 6, for a support structure according to at least some embodiments for the floor of the elevator cage is illustrated in plan view in FIG. 2. The support structure substantially consists of two arrangements 10 and 11 formed in the manner of a grating. The first arrangement 10, which defines a form of base structure which embraces approximately the entire floor area as seen in plan view, consists of a plurality of parallel extending longitudinal profile members 12 and transverse profile members 13. The substantially uniformly distributed longitudinal and transverse profile members 12 and 13 are arranged to intersect at right angles and define a first packing density. By the term "packing density" there is to be understood in this application the ratio of the volume of the individual chambers or cells, which are formed by walls or wall segments, to a total volume (corresponding in the present embodiment substantially to the total volume of the support structure). Since the walls or wall segments extend vertically with respect to the plane of the floor, the packing density can be derived from the area ratio. The support structure 6 comprises, by way of example, thirteen longitudinal profile members 12 and eighteen transverse profile members 13, wherein the respective spacings between the profile members are equal. The first arrangement 10 is in itself formed almost identically to the composite structure core, which is already known from the prior art, with the grating arrangement. With respect to further constructional details for this arrangement reference is accordingly made to, for example, EP 1 004 528 A1. A second arrangement 11 superimposed on the first arrangement 10 is disposed in the reinforcement region indicated by S. In some embodiments, the second arrangement 11 is designed to be fundamentally approximately identical to the first arrangement 10 and differs from the first arrangement 10 substantially only by the evidently smaller external size as well as the consequently smaller number of profile members.

The longitudinal and transverse profile members 12 and 13 of the first arrangement form a plurality of chambers in checkerboard distribution. The profile members 14 and 15 (four longitudinal profile members 14, five transverse profile members 15) respectively crossing at right angles divide the chambers associated with the first arrangement with the profile members 12 and 13 into four chambers of equal size. Through the superimposition of the second grating arrangement 11 on the first grating arrangement 10 a multiplication of the packing density accordingly results. The thickness of the profile members for the support structures as well as the profile member spacings and thus the packing densities can be dependent on, for example, the floor loading, top plate thicknesses and overall constructional height and can be optimized, for example, by means of FEM calculations.

As readily apparent from the plan view according to FIG. 2 the support structure 6 for formation of the local reinforcement has a second arrangement 11 disposed in the first arrangement 10 and superimposed on the first arrangement 10 in a region of overlap. The support structure 6 has outside the region of overlap the first packing density, which can be predetermined by the profile members 12 and 13.

Constructional details with respect to the construction of the cage floor 5 according to at least some embodiments can be inferred from the exemplifying embodiment according to FIGS. 3 to 6. The floor 5 comprises a base plate 7, a top plate 8 and a support structure 6, which is provided with a plurality of chambers, arranged therebetween. The floor is laterally closed by longitudinally and transversely extending side parts 20 and 21. The top plate is omitted in FIG. 4 for better understanding of the floor construction. The centrally arranged, locally reinforced zone with the multiple packing density is particularly clear from FIG. 4. The arrangement 11, which to a certain extent forms a double grating, has a square form in plan view. The external dimensions of the second arrangement 11 can be, for example, adapted to the constructional size of a component acting on the floor (cf. FIG. 1; for example, buffer element). The second arrangement could in plan view also comprise overall a rectangle with the same size ratios as the floor.

The components 6, 7 and 8 as well as 20 and 21 consist, for example, of sheet steel and can be produced and connected together by means of cutting, bending and welding methods. One possible method for producing the floor is, by way of example, apparent from FIG. 5. The profile members, which are joined together to form gratings, for the first and second arrangements 10 and 11 are fixed by, for example, welding and thus rigidly connected together. The second grating arrangement 11 is in the illustration according to FIG. 5 placed from above on the first grating arrangement 11. Respective mutually facing slots 16, 17 and 18, 19 are provided for approximately precisely fitting connection of the two arrangements 10 and 11.

According to the present embodiment the floor 5 has, as is evident, a single-layer support structure 6. The second arrangement 11 is disposed in the first arrangement 10 and thus in the same layer. Instead of a single layer or sandwich layer with the first arrangement 10 and the second arrangement 11 a floor with multiple support structure layers of that kind would also be conceivable in accordance with the respective purpose of use.

Figure 6:
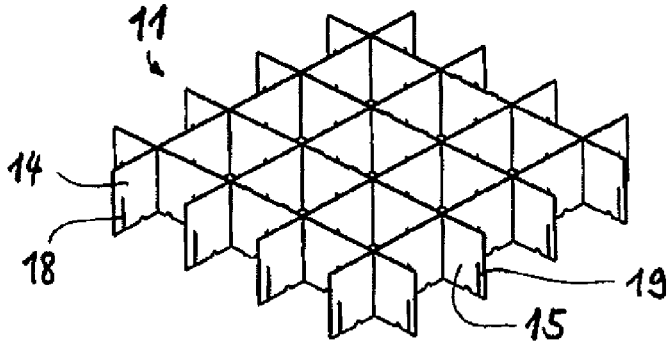
FIG. 6 shows a detail view of the support structure of FIG. 5

As is evident from the detailed illustration of the second grating arrangement 11 according to FIG. 6 the slots 18, 19 extend approximately at right angles to a plane of the floor or to the profile member longitudinal direction. The slots 18 and 19 in that ease extend from a profile member end face at the floor side up to approximately the center of the profile members 14, 15, whereby in the assembled state all profile members come to lie at the same level.

Figure 7:
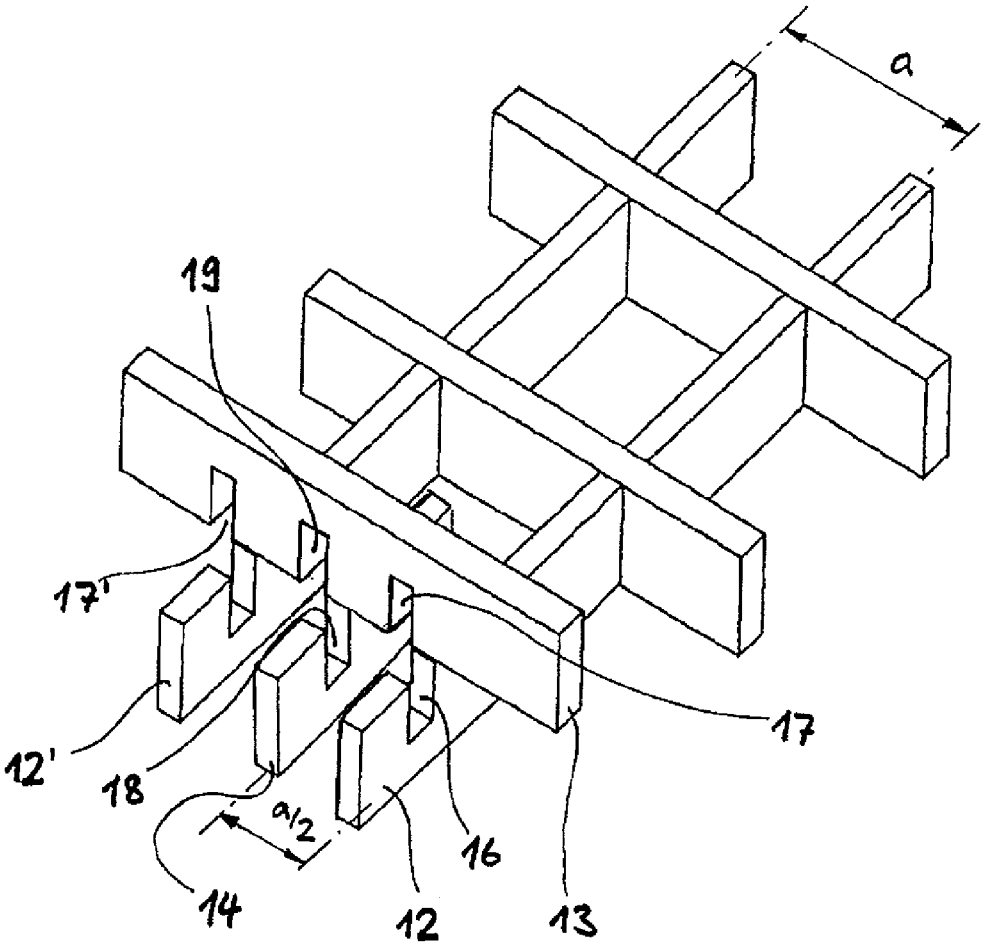
FIG. 7 shows a perspective illustration with respect to the basic construction of the support structure.

As evident from FIG. 7, the profile members of the second arrangement are respectively disposed between two profile members of the first arrangement. In FIG. 7, a profile member adjacent to the profile member 12 is denoted by 12'. The profile member 14 of the second arrangement is disposed approximately centrally between the profile members 12 and 12' which are spaced from one another at a spacing a. The central positioning and alignment is indicated by a spacing a/2. The profile spacing a can be between 5 centimeters and 20 centimeters and possibly between 10 centimeters and 15 centimeters. In the present embodiment the profile members of the second arrangement—by contrast to the preceding embodiment according to FIG. 6—are at the same time joined with the respective identically oriented profile members of the first arrangement to form the support structure. The thereby formed walls or wall segments of the segment arrangement (illustrated in FIG. 7 by way of example by the profile member 14) are mechanically positively connected by way of the slots with the walls or wall segments, which are formed by the profile members 12 and 13, of the first arrangement. In order to fix a support structure composed of the first and second arrangements the second arrangement can be welded to the first arrangement.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator cage floor, comprising:

a flat upper surface;

a flat lower surface; and a support structure arranged between the flat upper surface and the flat lower surface, the support structure comprising, a first plurality of elements approximately uniformly distributed with respect to a plan view of the support structure across the flat upper surface and the flat lower surface, the first plurality of elements defining a packing density of a first portion of the support structure, and a second plurality of elements, the second plurality of elements being superimposed on and, with respect to the plan view, overlapping the first plurality of elements, the first and second pluralities of elements defining a packing density of a second portion of the support structure, the packing density of the second portion of the support structure being higher than the packing density of the first portion of the support structure wherein the second portion overlaps less than an entire planar area of the first portion.

2. The elevator cage floor of claim 1, the first plurality of elements comprising a plurality of walls.

3. The elevator cage floor of claim 1, the first plurality of elements comprising a plurality of wall segments.

4. The elevator cage floor of claim 1, the first plurality of elements being arranged to at least partially intersect each other and being further arranged to stand on edge.

5. The elevator cage floor of claim 4, each element of the first plurality of elements comprising one or more slots for receiving one or more other elements of the first plurality of elements.

6. The elevator cage floor of claim 1, the second plurality of elements being arranged to at least partially intersect each other and being further arranged to stand on edge.

7. The elevator cage floor of claim 6, each element of the second plurality of elements comprising one or more slots for receiving one or more other elements of the second plurality of elements.

8. The elevator cage floor of claim 1, at least some of the elements of the second plurality of elements being disposed between respective adjacent elements of the first plurality of elements.

9. The elevator cage floor of claim 8, each of the elements of the second plurality of elements being disposed between respective adjacent elements of the first plurality of elements.

10. The elevator cage floor of claim 1, the elements of the second plurality of elements each having a length that is less than half of a length of the elevator cage floor.

11. The elevator cage floor of claim 1, the elements of the first plurality of elements and the elements of the second plurality of elements having a same thickness.

12. The elevator cage floor of claim 1, the second plurality of elements being arranged centrally relative to the flat upper surface and the flat lower surface.

13. An elevator installation, comprising:

an elevator cage disposed in a shaft, the elevator cage comprising an elevator cage floor, the elevator cage floor comprising, a flat upper surface, a flat lower surface, and a support structure arranged between the flat upper surface and the flat lower surface, the support structure comprising, a first plurality of elements approximately uniformly distributed with respect to a plan view of the support structure across the flat upper surface and the flat lower surface, the first plurality of elements defining a packing density of a first portion of the support structure in the plan view, and a second plurality of elements, the second plurality of elements being superimposed on and, with respect to the plan view, overlapping the first plurality of elements, the first and second pluralities of elements defining a packing density of a second portion of the support structure in the plan view, the packing density of the second portion of the support structure being higher than the packing density of the first portion of the support structure wherein the second portion overlaps less than an entire planar area of the first portion.

14. The elevator installation of claim 13, further comprising a buffer element arranged at a bottom of the shaft, the buffer element being positioned to exert a force on the second portion of the support structure when the buffer element comes in contact with the elevator cage.

15. An elevator cage floor, comprising:

a flat upper surface;

a flat lower surface configured for direct contact with a buffer element arranged at a bottom of an elevator shaft; and a support structure arranged between the flat upper surface and the flat lower surface, the support structure comprising, a first plurality of elements approximately uniformly distributed with respect to a plan view of the support structure across the flat upper surface and the flat lower surface, the first plurality of elements defining a packing density of a first portion of the support structure, and a second plurality of elements, the second plurality of elements being superimposed on and, with respect to the plan view, overlapping the first plurality of elements, the first and second pluralities of elements defining a packing density of a second portion of the support structure, the packing density of the second portion of the support structure being higher than the packing density of the first portion of the support structure wherein the second portion overlaps less than an entire planar area of the first portion and the buffer element exerts a force on the second portion when the buffer element comes in direct contact with the flat lower surface.

* * * * *